US006756701B2

(12) United States Patent
Elwart

(10) Patent No.: US 6,756,701 B2
(45) Date of Patent: Jun. 29, 2004

(54) SHOCK RESPONSIVE MOMENTARY RELAY

(76) Inventor: John Ernest Elwart, P.O. Box 5342, Playa Del Rey, CA (US) 90296

( * ) Notice: Subject to any disclaimer, the term of this patent is extended or adjusted under 35 U.S.C. 154(b) by 334 days.

(21) Appl. No.: 10/002,597

(22) Filed: Dec. 5, 2001

(65) Prior Publication Data

US 2003/0102719 A1 Jun. 5, 2003

(51) Int. Cl.[7] ..... H01H 35/00
(52) U.S. Cl. ..... 307/121; 307/116; 307/119; 340/690
(58) Field of Search ..... 307/116, 121, 307/119, 117; 340/690; 200/61.47

(56) References Cited

U.S. PATENT DOCUMENTS 3,501,745 A * 3/1970 Beckman ..... 200/52 R
5,742,235 A * 4/1998 Miche ..... 340/690

* cited by examiner

*Primary Examiner*—Robert L DeBeradinis

(57) ABSTRACT

This disclosure is directed to an earthquake or shock responsive electric relay, shutting off electric power, or actuating the use of power in lights, motors, alarms or any electric device, which includes any electric device used to stop the flow of water, gas oil or steam. The device utilizes a common relay type design whereby its reacting parts are balanced between a weight and a spring, a relay centered between upper and lower contactors so that upon occurrence of an earthquake or other violent shock, the device cannot remain balanced, thus causing the relay to conduct the contactor. After the shock has subsided, the relay returns to the balanced-position which is equal centered distance between the upper and lower contactors. The sensitivity of the device is controllable.

5 Claims, 2 Drawing Sheets

SHOCK RESPONSIVE MOMENTARY RELAY

FIELD OF THE INVENTION

The present invention relates to unexpected earth movement sensitive devices, particularly earthquake activated electro-mechanical devices. In particular, the present invention relates to a device that can trip a circuit breaker in an earthquake, utilizing a common electrical relay type design. Briefly, the device comprises a mounting assembly, a horizontal relay bar providing multiple contactors, a weight connectably to the horizontal relay bar, held in centered position by a spring. Upon the occurence of an earthquake, this device will not remain in balance and the weight will uncontrollably cause the relay bar it is attached connectably to vibrate and move up and down and the relay bar will make momentary contact with the top contactors or the lower contactors. The present invention has two distinct modes of operation, and depending on the wiring method in use connectably to the relay, this device can either trip a circuit breaker in an earthquake, or engage as a momentary switch, a motor or the like.

SUMMARY OF THE INVENTION

The shock responsive momentary relay of the present invention provides a vibration or shock actuated electric relay which can be used in a variety of products. If the present invention relay is wired to trip a circuit breaker, then all devices engaged to the particular circuit whereby the shock responsive momentary relay is connected to the circuit breaker, will be turned off by the present invention. The present invention relay, in another wiring mode, can turn on any electronic device in an earthquake. An example is a solenoid mounted attachably to a gas, steam or water line. The momentary switching action of the present invention will activate the responsive mechanism to turn on the solenoid in the pipe to block the flow. As a momentary relay, the present invention can turn on or off lights, alarms, garage doors, etc., provided that the compatible electronics which react to momentary switching exist in these devices. In most instances they do or can be added at minimal expense. Additionally, the present invention does not need to be reset after an earthquake, which is the common problem in all responsive devices. The present invention returns to a perfect engineered balance after all earthquake activity stops. In use connectably to a circuit breaker, after the breaker trips, the breaker is the only device that needs to be reset. In use with momentary switching responsive devices, any device activated by the present invention can be turned off at the source location after the earthquake activity stops, as the present invention will not activate a new response until another earthquake has occurred.

The objects and advantages of the present invention are obtained by an engineered balance whereby the relay is held in a centered non continuity state between two sets of two contactors, one set of two above the relay and one set of two below the relay. The centering is achieved by a balance provided by a spring, and a weight attachably connected to the bottom of the relay. Each contactor is provided with adjustment means with a threaded hole through the contactor and a screw whereby the gap between the relay and the contactor can be reduced from a maximum of one quarter inch to any gap lesser than one quarter of one inch.

Upon the occurence of an earthquake, or other shock, the present invention cannot possibly remain in perfect balance, since perfect balance is designed in the relay to contactor spacing. Depending on the sensitivity adjustment which is adjustable, this device relay will vibrate and make momentary contact with either the top or the lower contactors. When contact is made, the present invention will cause a curcuit breaker to trip; if the present invention is electrically connected to a circuit breaker and wired as to create a short. This is accomplished by connecting one neutral terminal from the electrical panel box and connecting it to either the right side or left side of the contactor. In this instance, both top and lower contactors must be connected together at the side that the neutral wire is installed. Next, the hot lead coming out of the circuit breaker is left in place, but a second wire is installed in the breaker connectably to the same breaker and is attached to the opposite side of the present invention contactor, and the top and the lower contactors are connected together.

Since the relay is a solid metal bar, and not a two pole set of contacts, the result of the aforementioned wiring will create an electrical short thereby tripping the circuit breaker when an earthquake causes the present invention relay to vibrate and make momentary contact. In the instance of using the device to turn on power, the neutral wire is not used and a hot lead from any source can be installed on one side of the contactors, and the load wire connected to the opposite side. As long as the device used to be energized has compatible electronics to respond to a momentary switch, that device will be energized in event of an earthquake or other shock.

After the earthquake has subsided, the engineered balance returns to the designed centered balance which is equally spaced distance between the top and lower contactors and does not need to be reset. This device must be mechanically fastened to a building or its related parts to be accurate.

DETAILED DESCRIPTION OF THE INVENTION

Figure 1:
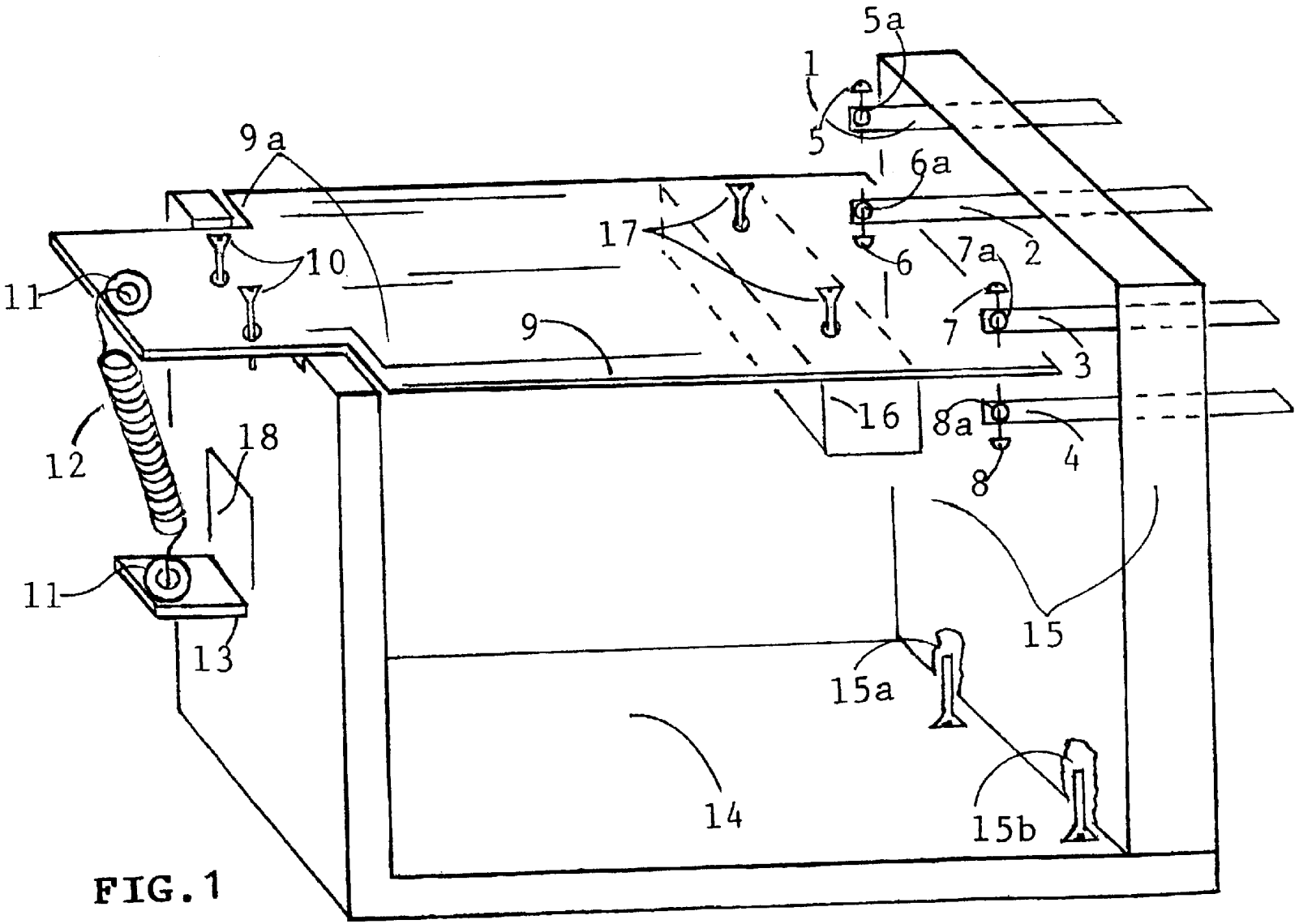
FIG. 1 shows a perspective view of the relay of the present invention.

Referring to FIG. 1, the relay of the present invention has a base portion 14, which is an 'L' shaped metal one piece support for the entire relay. On the left side of this base is an extruded part from the same metal of 14, which is spring holder 13. The stamped out recess to 13 is 18. Therefore the spring which creates resistive tension to balance the relay starts at 13 and is connectably engaged to create resistance to relay bar 9. Spring 12 is a spring that will lift up relay bar 9 plus the weight 16 and keep it centered between contactors 1, 2, 3, 4. To adjust the relay for sensitivity, screws 5, 6, 7, 8 are turned clockwise to increase the response. The holes provided are threaded. These are 5*a*, 6*a*, 7*a*, 8*a*. The contactor housing 15 is secured to base portion 14 by screws 15*a*, 15*b*. Screws 17 hold weight 16 into position on relay bar 9.

Figure 2:
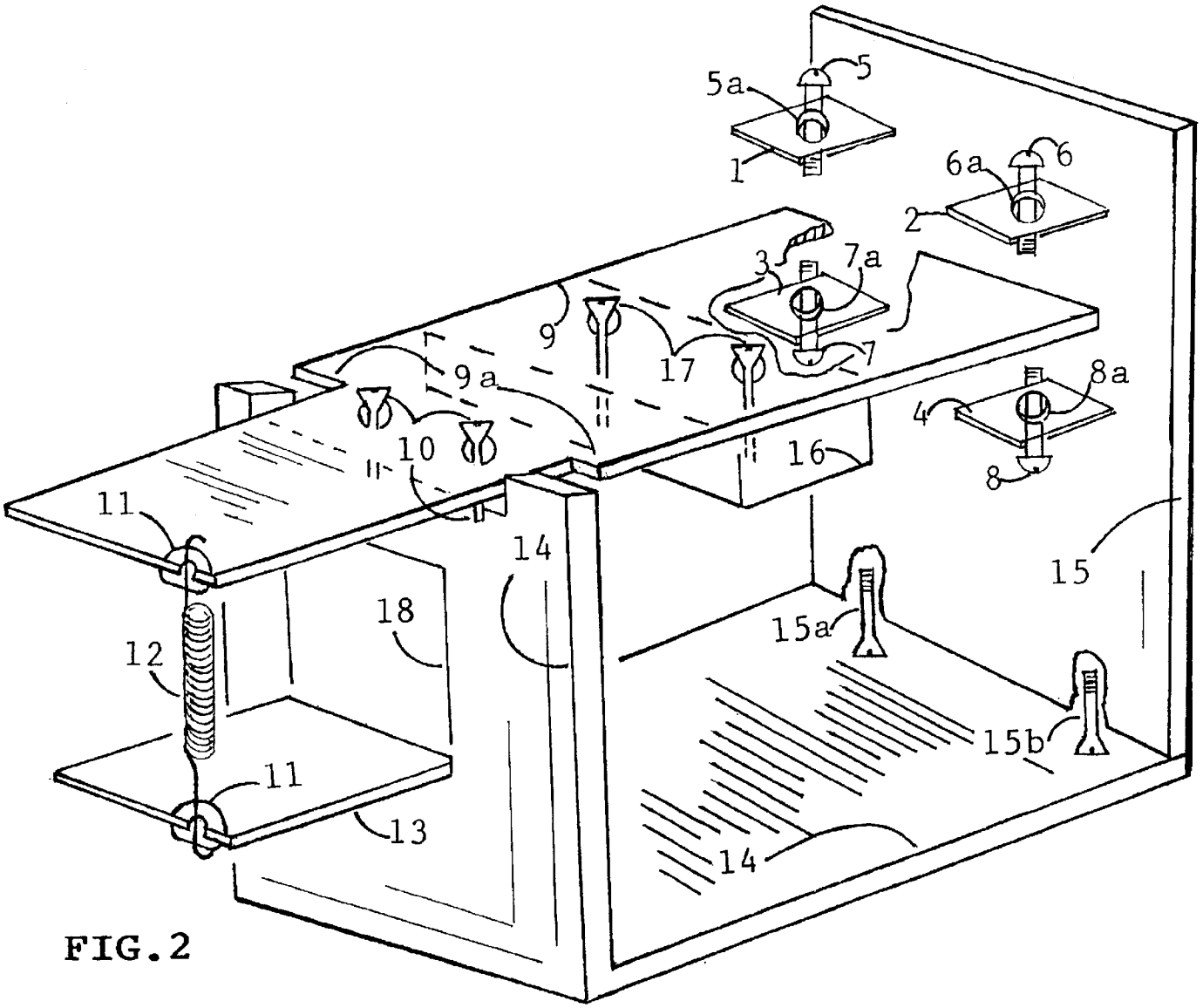
FIG. 2 shows an exploded view of the frame housing connection parts.

Referring to FIG. 2, the notched out top of base portion 14 is seen, as well as the restraining screws 10, which prevent relay bar 9 from moving forward. Also, the notched portion of relay bar 9, notch 9*a* is seen interfitting with the base portion. Since the relay bar is a solid metal piece, grommets 11 are shown in this exploded view. The insulated grommets are necessary to prevent the spring from contacting electrical resistance for the possibility of electric arc from either de-calibrating the spring 12 or destroying it from usage.

I claim:

1. A shock actuated electric relay comprising:

a coilless relay, having a frame housing extending horizontally as a base portion and extending vertically connectably to a upper portion in such a manner as to support the upper members and a notched portion in said assembly to enable the connection of the upper members to frame;

a singular pole movable horizontally disposed relay bar and a notched portion in relay bar provided to fit into frame of said frame housing;

a weight connectably fastened to said relay bar and holes in stated weight to enable connection to relay bar;

a relay bar with holes engaged to meet in connection to weight as stated to connect weight and relay bar;

means for providing weight for movement in earthquake or violent shock;

a spring connectably fastened to relay bar and fastened to frame housing;

means to provide resistance to said weight and to provide response in earthquake or violent shock;

a grommet, insertably connected to hole in relay bar and a grommet insertably connected to hole in frame housing;

means to electrically insulate spring from frame housing and relay bar;

a hole disposed in notched end of relay bar;

a hole disposed in frame housing;

means to insert said grommets at both points to engage said spring and to engage resistive portions of said device to be responsive in earthquake or violent shock;

an extruded outwardly projecting vertical frame portion of frame housing extending horizontall from same said frame as one unitary part;

means for providing a connection point for spring and said grommet.

2. The shock actuated electric relay of claim 1, wherein the relay is a coilless relay.

3. The shock actuated electric relay of claim 2, wherein the relay bar is a singular pole relay bar.

4. The shock actuated electric relay of claim 3, wherein the relay bar is connectably fastened to a weight.

5. A shock actuated electric relay comprising;

a contactor assembly consisting of four contactors, each of four contactors having a threaded hole and each threaded hole having a screw as an assembly part to enable adjustment of said assembly;

means to adjust the sensitivity of the device for response in an earthquake or violent shock;

a contactor assembly consisting of four contactors whereby in a non electrified state do not make contact with relay bar;

a contactor assembly consisting of four contactors whereby in an electrified state do not make contact with the relay bar;

means provided by relay as a coilless relay;

a contactor assembly consisting of four contactors whereby a relay bar is provided with a centering apparatus;

said centering apparatus provided as the responsive portion to respond in earthquake or violent shock.

* * * * *